United States Patent [19]

Litauer

[11] 4,259,544

[45] Mar. 31, 1981

[54] ELECTRIC CABLE WITH A LONGITUDINAL STRENGTH MEMBER

[75] Inventor: Andre Litauer, Chilly Mazarin, France

[73] Assignee: Societe Anonyme dite: Les Cables de Lyon, Lyons, France

[21] Appl. No.: 944

[22] Filed: Jan. 4, 1979

[30] Foreign Application Priority Data

Jan. 10, 1978 [FR] France ..... 78 00506

[51] Int. Cl.[3] ..... H01B 7/24

[52] U.S. Cl. ..... 174/102 R; 174/110 N; 174/120 R; 174/121 R; 174/121 SR

[58] Field of Search ..... 174/110 N, 121 R, 121 SR, 174/120 R, 120 C, 120 SR, 102 R

[56] References Cited

U.S. PATENT DOCUMENTS

| | | | |
|---|---|---|---|
| 3,265,809 | 8/1966 | Morieras | 174/121 R |
| 3,482,034 | 12/1969 | Rhoades | 174/121 R X |
| 3,634,607 | 1/1972 | Coleman | 174/120 |
| 3,672,974 | 6/1972 | Tomlinson | 174/121 SR |
| 3,980,808 | 9/1976 | Kikuchi et al. | 174/102 E |
| 4,059,724 | 11/1977 | Ide | 174/102 R X |
| 4,151,237 | 4/1979 | Ney | 174/121 SR |

FOREIGN PATENT DOCUMENTS

| | | | |
|---|---|---|---|
| 2330673 | 12/1974 | Fed. Rep. of Germany | 174/117 F |
| 2522849 | 2/1976 | Fed. Rep. of Germany | 174/121 R |
| 2516472 | 9/1976 | Fed. Rep. of Germany | 174/107 |

*Primary Examiner*—Richard R. Kucia

*Attorney, Agent, or Firm*—Sughrue, Rothwell, Mion, Zinn and Macpeak

[57] ABSTRACT

An electric cable and in particular a coaxial cable, said cable having at least one conductor surrounded by electrical insulation and at least one longitudinal strength member formed by a cord of aromatic polyamide fibres, disposed parallel to the conductor or twisted in a helix therearound. Various kinds of cords are described: twisted; non-twisted; in one or in several layers; embedded in insulation or constituting the insulation.

3 Claims, 5 Drawing Figures

ELECTRIC CABLE WITH A LONGITUDINAL STRENGTH MEMBER

FIELD OF THE INVENTION

The present invention relates to an electric cable which has at least one conductor surrounded with an electrical insulator and at least one longitudinal strength member made of synthetic resin. It relates more particularly to coaxial cables of this type.

BACKGROUND OF THE INVENTION

Electric cables used at present include strength members so that they can be suspended between posts or vertically. These strength members are constituted by steel wires which carry the mechanical stresses. These wires are sometimes inserted in the cores of cables (coaxial sub-marine cables) or between conductors. In most cases they are wound round cables and constitute their outer reinforcement.

The disadvantage of metal strength members is that they modify the dielectric characteristics of the insulation. Further, they increase the volume of the cable when they constitute its outer reinforcement and in any case, they increase its weight very appreciably.

It has already been proposed to provide electric cables with longitudinal strength members made of a synthetic resin, for example an aliphatic polyamide such as Nylon, or ethylene-glycol polyterephthalate or polyesters, or polyolefines, or polycarbonates, etc. (French Pat. No. 2 039 355, U.S. Pat. Nos. 3,265,809 and 3,980,808). Such strength members have the disadvantage of allowing the cable to elongate appreciably and of not being very resistant to moisture, so that metal strength members have continued to be used despite their disadvantages.

SUMMARY OF THE INVENTION

The present invention aims to provide a cable with a longitudinal strength member of little elongation, which withstands moisture well and which is also light and does not disturb the dielectric characteristics of the insulation and can even constitute the insulation itself alone.

The electric cable according to the invention is characterized in that said synthetic resin of the strength member is an aromatic polyamide.

It further includes preferably at least one of the following characteristics:

Its strength member is constituted by a plurality of cords of resin-agglomerated aromatic polyamide fibres, disposed around the conductor and extending parallel thereto;

It includes, around its conductor, at least four cords embedded in polyethylene insulation;

It includes, around its conductor, six cords each formed by seven strands twisted together, three of said cords being twisted in one helical direction and three other cords which alternate with the first three cords being twisted in the opposite helical direction, the set of said cords being embedded in polyethylene insulation;

It includes, around its conductor, two layers of cords of determined diameter, the inner layer comprising a regular alternation of six cords of said diameter and three cords of smaller diameter having polyethylene sheaths so as to make up the same outside diameter as the first six cords, the outer layer comprising a regular alternation of three cords of said diameter and twelve cords of smaller diameter having polyethylene sheaths so as to make up the same outside diameter as the first three cords, the winding pitch of the outer layer being greater than that of the inner layer and the assembly of said cords being embedded in polyethylene insulation;

It includes, between the conductor and the first layer of cords, and between the two layers of cords, a sealing compound constituted by polyisobutylene impregnated with silica powder; and Its strength member is constituted by a plurality of cords of resin-agglomerated aromatic polyamide fibres, twisted in a helix around the conductor and simultaneously constituting its dielectric.

Coaxial cables in accordance with the invention are described hereinbelow by way of example and with reference to the figures of the accompanying drawings.

DESCRIPTION OF PREFERRED EMBODIMENTS

Figure 1:
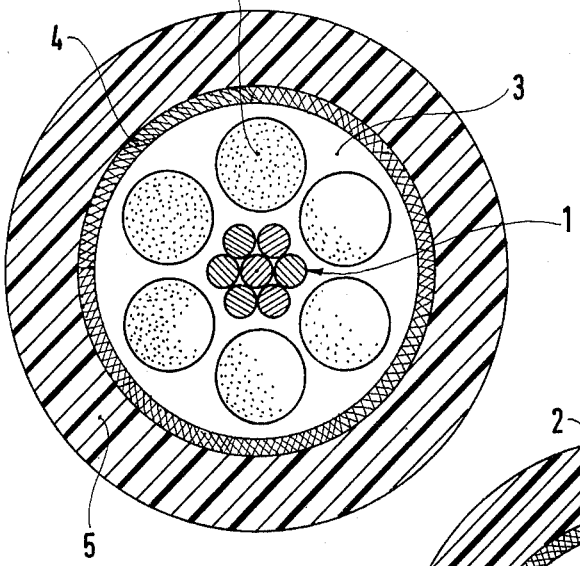
FIG. 1 is a transversal cross-section of a coaxial cable with six supporting cords (trademark Cef), made of aromatic polyamide (trademark Keylar) manufactured by Du Pont De Nemours and marketed by Cordes Europe France.

The cable of FIG. 1 includes a non-swaged central conductor 1 consisting of seven copper wires twisted together. The conductor is surrounded by six strength members in the form of cords 2 (trademark Cef), made of fine fibres of aromatic polyamide (trademark Kevlar) marketed by Du Pont de Nemours, which fibres are braided and impregnated with a hardening resin. These cords are embedded in a polyethylene insulator 3 (not shaded in the figures, for clearness' sake). Their relative density is 1 to 1.2, their breaking strength 1500 to 1800 $N/mm^2$ and their elongation at breakage from 2 to 3%. The assembly is formed by extruding the insulator in an extrusion machine which has an axial die through which the central conductor and the cords pass.

The outer conductor is constituted by a braid 4 of copper wire. The assembly is surrounded by a polyvinyl chloride or polyethylene sheath 5.

Figure 2:
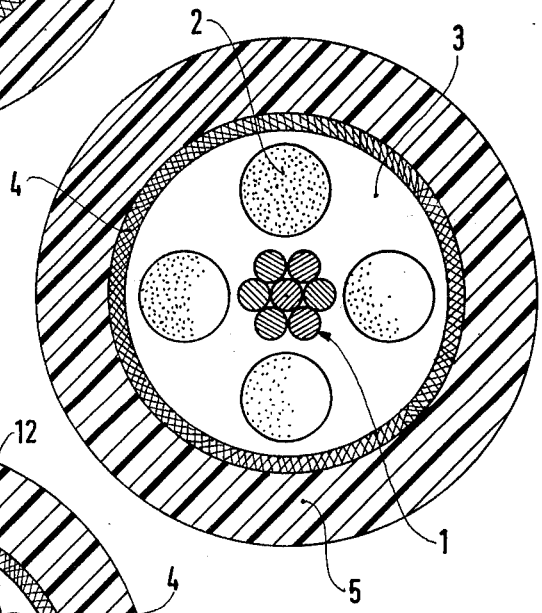
FIG. 2 is a transversal cross-section of a second coaxial cable having four supporting cords analogous to those of the cable of FIG. 1.

The cable of FIG. 2 is analogous to that of FIG. 1, but includes only four Kevlar cords 2 each having a diameter a little larger than that of the cords of FIG. 1.

Figure 3:
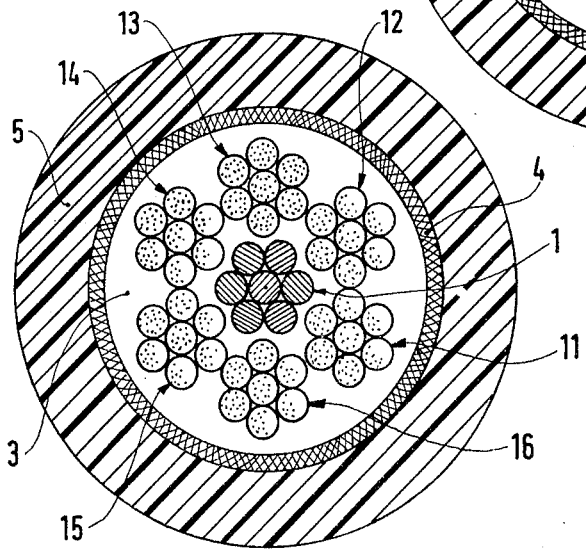
FIG. 3 is a transversal cross-section which illustrates a coaxial cable with six supporting cords each constituted by seven strands twisted together.

The cable of FIG. 3 includes a non-swaged central conductor 1 consisting of seven copper wires twisted together. The central conductor is surrounded by polyethylene insulation 3 in which six Cef cords are embedded each consisting of seven Kevlar strands twisted together and agglomerated by a resin. In three of these cords 11, 13, 15, the strands have a right-hand lay, while the other three 12, 14, 16, which alternate with the first three, have a left-hand lay. Like the preceding cables, the present cable further includes an outer conductor 4 made of copper wire braid and a polyvinyl chloride or polyethylene sheath 5.

Figure 4:
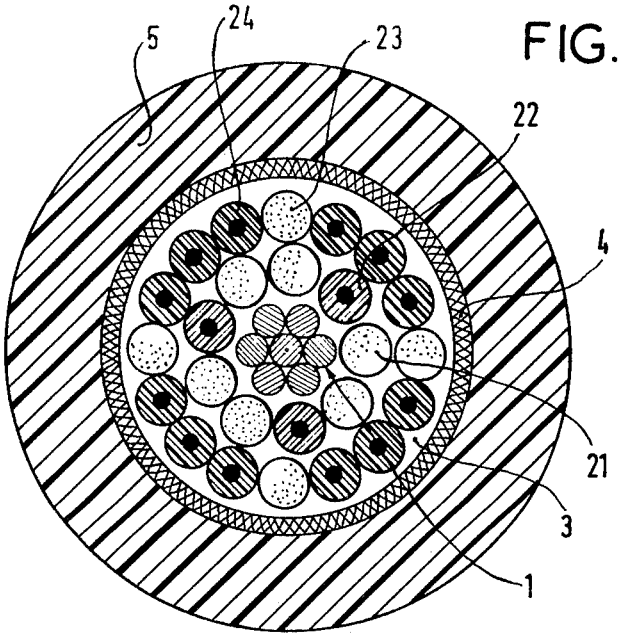
FIG. 4 is a transversal cross-section which illustrates a coaxial cable with two layers of supporting cords, an inner layer with nine cords and an outer layer of sixteen cords.

The cable of FIG. 4 includes a non-swaged central conductor 1 consisting of seven copper wires twisted together. The conductor is surrounded by two concentric layers of Cef cords. The inner layer comprises six cords 21 of Kevlar fibres alternating with three smaller diameter cords 22 of Kevlar fibres, the cords 22 having polyethylene sheaths to make up their diameters to be the same as those of the other cords. All nine of these cords are wound helicaly round the central conductor. The outer layer comprises four cords 23 which alternate with twelve smaller diameter cords 24 having polyethylene sheaths to make up their diameters to be the same as the diameter of the cords 23. The cords of both layers are wound helically around the central conductor and the pitch of the outer layer is greater than that of the inner layer. The assembly constituted by the central conductor and the two layers of cords is embedded in polyethylene insulation 3 and surrounded by a braid 4 of copper wires and by an outer sheath of polyvinyl chloride or of polyethylene.

Further, improved sealing between the first layer of cords and the central conductor and between the second layer and the first can be provided by coating the periphery of the central conductor and that of the first layer of cords with a low molecular weight sealing compound, such as polyisobutylene, which is impregnated with silica powder.

Figure 5:
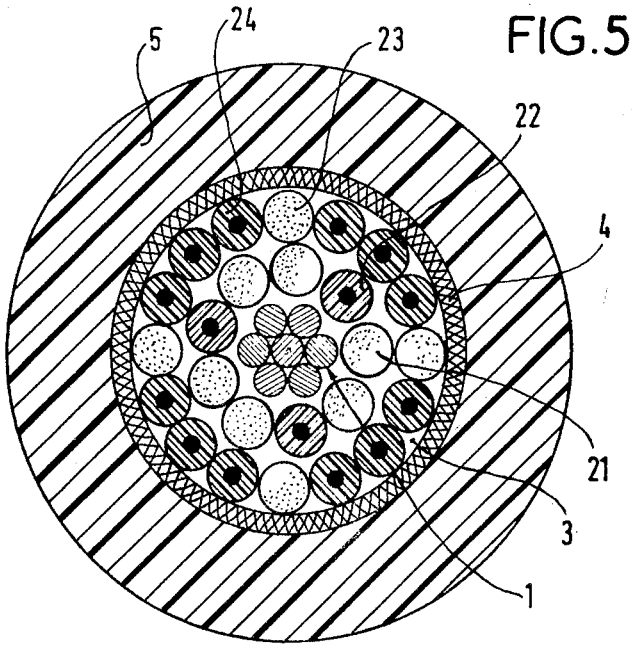
FIG. 5 is a transversal cross-section which illustrates a coaxial cable analogous to that in FIG. 4, but in which the cords simultaneously constitute the insulation.

In the cable of FIG. 5, the disposition of the cords is the same as in FIG. 4, but the cords are cabled in a helix and are not embedded in polyethylene insulation. The cords themselves, preferably assembled with a sealing compound added to them, constitute the dielectric. The outer layer of cords is in contact with the braid of copper wires 4, which in turn is surrounded by the external sheath 5.

The proportion of Kevlar polyamide threads or tapes incorporated in the dielectric is chosen as a function of the properties required for the cable (mechanical strength, impedance, attenuation etc.)

There is very little elongation of such a cable under stress (about 1 to 2%) and its bulk is very small. This saves space and reduces weight, winding radius, wind resistance, and frosting, thereby reducing the strength requirements of the cable and its supports.

Although the cables which have just been described by way of example appear to be preferred embodiments, it will be understood that various modifications can be made thereto without going beyond the scope of the invention, it being possible to replace some of their components by others which would perform an analogous technical function, or to add other components.

I claim:

1. An electric cable comprising:

a central conductor, an insulator surrounding said central conductor, said insulator bearing a plurality of embedded cords of resin agglomerated fibers of aromatic polyamide, said cords being disposed around said central conductor and making up at least part of said insulator, an outer conductor disposed around said insulator, an outer sheath surrounding said outer conductor, said cords extending parallel to said conductor comprising six cords in number with each cord being formed by seven strands twisted together, three of said cords being twisted in one helical direction and the other three cords being twisted in in the opposite helical direction and being disposed alternately with the first three cords, and with the set of said cords being embedded in polyethylene insulation.

2. An electric cable comprising:

a central conductor, an insulator surrounding said central conductor, said insulator bearing a plurality of embedded cords of resin agglomerated fibers of aromatic polyamide, said cords being disposed around said central conductor and making up at least part of said insulator, an outer conductor disposed around said insulator, an outer sheath surrounding said outer conductor, said cords extending parallel to said central conductor, said plurality of cords comprising two layers of cords of predetermined diameter, the inner layer comprising a regular alternation of six cords of given diameter and three cords of smaller diameter having polyethylene sheaths so as to make up the same outside diameter as the first six cords, the outer layer comprising a regular alternation of three cords of given diameter and twelve cords of smaller diameter having polyethylene sheaths so as to make up the same outside diameter as the first three cords, the winding pitch of the outer layer being greater than that of the inner layer and the assembly of said cords being embedded in polyethylene insulation.

3. A cable according to claim 2, including a sealing compound constituted by polyisobutylene impregnated with silica powder and disposed between the said central conductor and the first layer of cords, and between the two layers of cords.

* * * * *